US006021784A

United States Patent [19]

Yuhara

[11] Patent Number: 6,021,784

[45] Date of Patent: Feb. 8, 2000

[54] COSMETIC CASE

[75] Inventor: Yukitomo Yuhara, Abiko, Japan

[73] Assignee: Yoshida Industry Co., Ltd., Tokyo, Japan

[21] Appl. No.: 09/283,953

[22] Filed: Apr. 1, 1999

[30] Foreign Application Priority Data

| | | | |
|---|---|---|---|
| Apr. 2, 1998 | [JP] | Japan | 10-090044 |
| May 14, 1998 | [JP] | Japan | 10-131825 |
| Jun. 11, 1998 | [JP] | Japan | 10-163888 |
| Jun. 11, 1998 | [JP] | Japan | 10-163889 |

[51] Int. Cl.[7] ..... A45D 33/00

[52] U.S. Cl. ..... 132/293; 295/303; 295/301; 206/581; 220/343; 220/844

[58] Field of Search ..... 132/293, 295, 132/315, 301, 286, 303; 206/524.1, 581, 823; 220/844, 469, 324, 335, 343

[56] References Cited

U.S. PATENT DOCUMENTS

| | | | |
|---|---|---|---|
| 4,615,464 | 10/1986 | Byrns | 220/469 |
| 4,815,608 | 3/1989 | Silberberg | 132/295 |
| 5,022,529 | 6/1991 | Kang | 206/581 |
| 5,320,239 | 6/1994 | Favre | 220/343 |
| 5,431,177 | 7/1995 | Kecman | 132/301 |

FOREIGN PATENT DOCUMENTS

| | | |
|---|---|---|
| 50-44316 | 12/1975 | Japan . |
| 52-1961 | 1/1977 | Japan . |
| 58-26405 | 2/1983 | Japan . |
| 58-30484 | 7/1983 | Japan . |
| 62-13541 | 4/1984 | Japan . |
| 59-67104 | 5/1984 | Japan . |
| 59-67105 | 5/1984 | Japan . |
| 62-13542 | 4/1987 | Japan . |
| 11-56455 | 3/1999 | Japan . |

*Primary Examiner*—Gene Mancene
*Assistant Examiner*—Pedro Philogene
*Attorney, Agent, or Firm*—Morrison & Foerster LLP

[57] ABSTRACT

A cosmetic case including a container and cover part connected by a hinged joint, in which the hinge pin is formed of the same synthetic resin as the container and cover parts. The hinged joint is formed by hinge blocks (integrally formed on the container part) pivotably connecting to a hinge body (integrally formed on the cover part) by a hinge pin inserted through a round bore formed through the hinge blocks and hinge body. The synthetic resin hinge pin is a concentric three layer structure in radial cross section in which the outer and inner layers are joined by an adhesive middle layer. A collar flange and center bore are formed on the hinge block and hinge body, respectively, around the hinge pin.

26 Claims, 14 Drawing Sheets

COSMETIC CASE

BACKGROUND OF THE INVENTION

1. Field of the Invention

The invention relates to a synthetic resin cosmetic case of the type in which a cover part is pivotably joined to a container part by means of a hinged joint.

2. Description of the Related Art

A portable cosmetic container, commonly called a "compact," is generally employed by people as conveniently carrying cosmetic substances. An existing type of a widely used compact is generally comprised of a structure in which the rear extremity of a cover part is pivotably joined to the rear extremity of a container part by means of a hinge mechanism, thus allowing the cover part to movably pivot on the hinge as means of exposing or sealing the cosmetic substance held in the container part. This type of cosmetic container further employs a clasp mechanism installed at the front extremities of the aforesaid cover and container parts, said clasp mechanism serving as means of securing the cover in a position which seals the contents of the container.

In many cases both the container and cover part of the cosmetic case are fabricated from synthetic resin for reasons which include the desire to simplify the manufacturing process, reduce the weight of the compact, and provide convenient means of modifying the appearance of the compact to attain various decorative effects.

In cases where the aforesaid container and cover parts are formed from synthetic resin, the hinge is normally fabricated from a metallic material. As recycling is becoming an increasingly desirable and prevalent method of conserving natural resources through reprocessing discarded items, the presence of metallic hinge pins in an otherwise all resin cosmetic container makes it difficult, time consuming, and inconvenient to recycle the compact as a synthetic resin product. Specifically, the metal hinge pins, which are often pressed into the container and cover parts through interference fit, must be removed before the compact can be recycled. Considering the difficulty of recycling a compact made from both synthetic resin and metal components, it would be advantageous to fabricate all of the compact's components, including the hinge pins, from a synthetic resin as means of making the compact completely recyclable.

SUMMARY OF THE INVENTION

The invention proposes a cosmetic case structure wherein the container part, cover part movably installed thereto, and the hinge pin are all fabricated from the synthetic resin, thereby eliminating the need to remove a metallic hinge pin when it becomes desirable to discard and recycle the cosmetic case.

The invention proposes a cosmetic case structure wherein the synthetic resin hinge pin is constructed so as to provide a smooth opening and closing action between the container and cover parts, and to provide a smooth and pleasant tactile feeling, and wherein the hinge is constructed to provide sufficient strength in regard to its function, even the use of resin hinge pin.

The invention proposes a cosmetic case structure wherein the synthetic resin hinge pin can be quickly and easily assembled to the cosmetic case.

The invention proposes a cosmetic case structure wherein the use of a synthetic resin hinge pin allows for the coloring, finish, and design of said hinge pin to be executed in a manner as to create pleasing appearances of the cosmetic case not possible with a conventional metallic hinge pin.

The cosmetic case put forth by one aspect of the invention is comprised of a container part consisting of synthetic resin material and containing cosmetic substance, a cover part consisting of a synthetic resin material and being pivotably installed to the container part so as to expose or seal the container part, a mutually connecting hinge block part and hinge body part integrally formed to the aforesaid container part and cover part respectively, a hinge pin bore formed through the aforesaid hinge block and hinge body, and a synthetic resin hinge pin installed within the aforesaid hinge bore as means of pivotably connecting the aforesaid hinge block and hinge body.

Because the invention provides for a cosmetic case in which the hinge pin is made from synthetic resin alike the container and cover parts, the cosmetic case can be disposed of in a environmentally sound manner, by means of a plastic recycling process, without the troublesome necessity of removing the hinge pins.

Moreover, the invention also provides for a free stop function wherein the cover part is able to maintain any open angle in relation to the container part by means of the friction applied between the hinge pin and hinge bore, the aforesaid stop function resulting from the elastic adhesion effect occurring between like synthetic resin pieces held in mutual contact.

A hinge pin is preferably comprised of three concentric layers in radial cross section whereby the outer layer is comprised of a soft resin, the inner core layer of a hard resin, and the middle layer of an adhesive as means of joining the hard inner layer and soft outer layer.

The aforesaid soft outer layer of the hinge pin is preferably comprised of polypropylene, polyethylene, or other appropriately soft resin, and the aforesaid inner core layer of polycarbonate, nylon, or other appropriately hard resin.

Because the outer layer of the hinge pin is made of soft resin material maintained in mutual pressure contact with the wall of the bore, an elastic adhesive effect is generated which creates resistance against the opening and closing action of the cover part, but only enough resistance to provide a smooth and pleasing feeling to the opening and closing movement of the cover.

Because the inner core layer of the hinge pin is constructed of a hard resin material, the strength and rigidity of the hinge pin are maintained at a desirably high level despite the concurrent usage of the soft resin outer layer.

The hinge pin can also be fabricated as a concentric two layer construction in radial cross section wherein both concentric layers are made of the same synthetic resin, but in which a lubricating component is added to the resin composition of the outer layer, and a reinforcing component to the resin composition of the inner layer as means of obtaining the desired qualities.

The aforesaid lubricating component may consist of silicon, while the aforesaid reinforcing component may consist of glass fiber or carbon fibers.

Since the outer layer of the hinge pin, which frictionally contacts with the inner surface of the pin bore, is fabricated from a resin to which a lubricating component has been added, it provides sufficient friction between the two components. This creates a mechanism through which the cover part can be smoothly opened and closed with a sufficient amount of externally applied pressure.

As the inner core layer of the hinge pin is constructed of a synthetic resin which includes a strengthening component, a sufficient level of hinge strength is maintained as means of preventing the hinge pin from bending or distorting excessively.

Moreover, since the hinge pin can be fabricated as a one piece structure, it eliminate the need for a bonding layer between the concentric outer layer and inner core layer, thus providing simplified structure.

A boss type hinge structure comprised of a rotatably contacting collar flange and center boss, both round in cross section, may be formed radially around the circumference of the hinge pin on the aforesaid hinge block and hinge body respectively. The shear stress normally applied to the hinge pin through the opening and closing movement of the cover part is absorbed by the aforesaid collar flange and center boss, thus providing a mechanism capable of preventing damage to the hinge pin.

The collar flange and center boss are formed cylindrically, and a cutout section is formed radially through the wall of the aforesaid collar flange as means of allowing the center boss to be inserted within the collar flange. The cutout section makes it unnecessary to force fit the center boss into the collar flange, thus providing for easy assembly of the two components.

The mating surfaces of the aforesaid collar flange and center boss may also be formed hemispherical as means of further aiding in their mutual assembly. In this case the aforesaid cutout section may be eliminated.

A guide bore is formed at the outward extremity of the hinge bore, and to a diameter larger than the outer diameter of the hinge pin, as means of aiding in the insertion of the hinge pin into the hinge bore. That is, the guide bore provides means wherein the hinge pin can be more easily inserted up to and aligned with the end of the hinge bore at the time of assembly.

The guide bore may be made to the same length as or longer than the hinge pin. The entire length of the hinge pin is thus able to smoothly insert and temporarily reside in the guide bore as means of aiding in the forcible insertion of the hinge pin into the hinge bore without deforming the hinge pin. The cosmetic case assembly time is shortened because a large amount of force can be applied to the hinge pin during its insertion operation without the possibility of distorting or damaging the pin.

The insertion end of the hinge pin is made to a smaller radial cross section than the hinge pin shank as means of aiding in the insertion of the hinge pin into the hinge bore, thus making the cosmetic case assembly operation faster and easier.

The cross section of the hinge pin may be structured to a non-round shape with multiple circumferential surfaces which intermittently contact the round wall of the hinge pin bore. In cases where the hinge pin cross section is formed as a non-round shape, it becomes possible to relieve the stress on the hinge pin generated by pressure contact of the hinge pin against the bore wall, thus providing means of extending the service life of the hinge pin through improved abrasion resistance and reduced torsional distortion.

The hinge pin may be fabricated to the same color as the container part, cover part, or both. Making the hinge pin the same color as the surrounding material provides a camouflage effect whereby the hinge pin is not easily visible, thus improving the appearance of the cosmetic case and increasing its perceived value.

The hinge pin may be fabricated to the same degree of transparency as the container part, cover part, or both. Making the hinge pin as transparent as the surrounding material prevents the hinge pin from being visibly apparent as would be the case with an opaque metallic hinge pin, thus improving the appearance of the cosmetic case.

The hinge pin may be fabricated of the same resin material as the container part, cover part, or both. Forming the hinge pin in this manner makes it possible to manufacture the hinge pin with the same dieset utilized for the container or cover part, thus reducing the number of molding processes, tooling expenses, and cost of the finished product. Because the hinge pin becomes an integral component of the container or cover part, it is able to blend in visually with the surrounding material, thus improving the appearance of the cosmetic case and increasing its perceived value.

DESCRIPTION OF PREFERRED EMBODIMENTS

The following discussion will explain various embodiments of the invention with reference to the attached figures.

Figure 1:
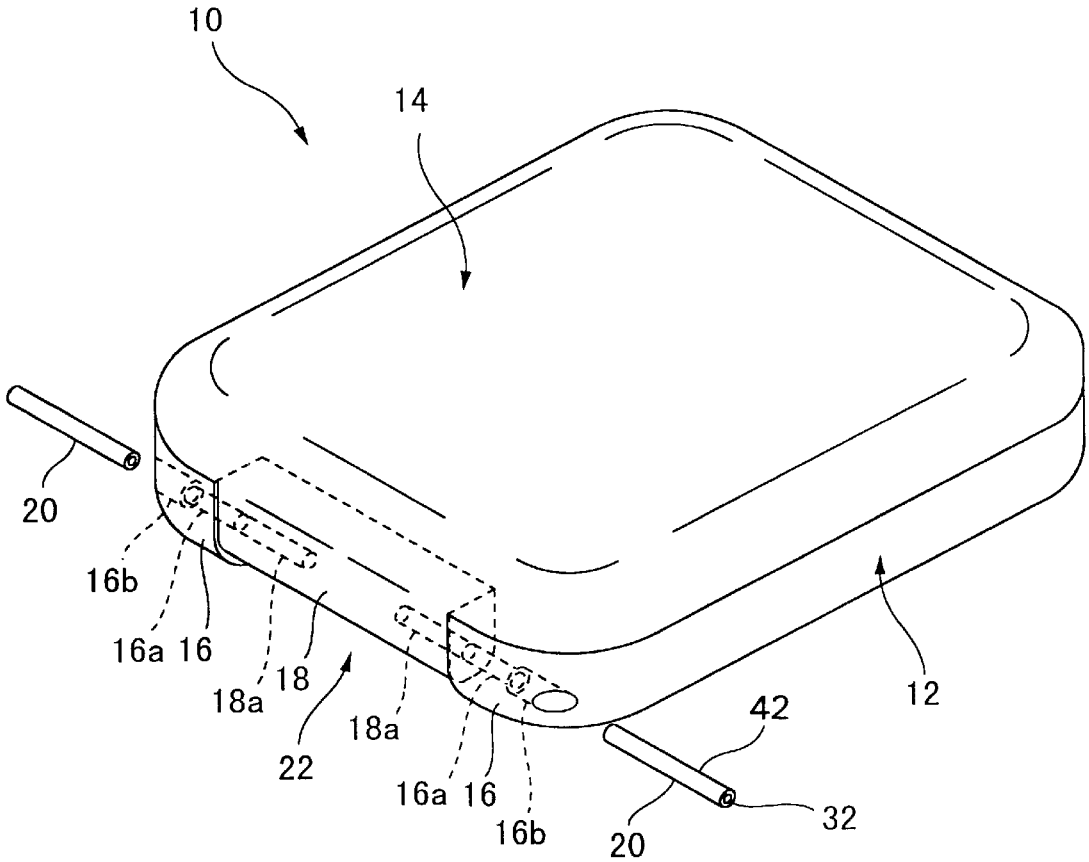
FIG. 1 is an oblique view of the first embodiment of a cosmetic case according to the invention with the hinge pins shown in a non-installed position.
Figure 2:
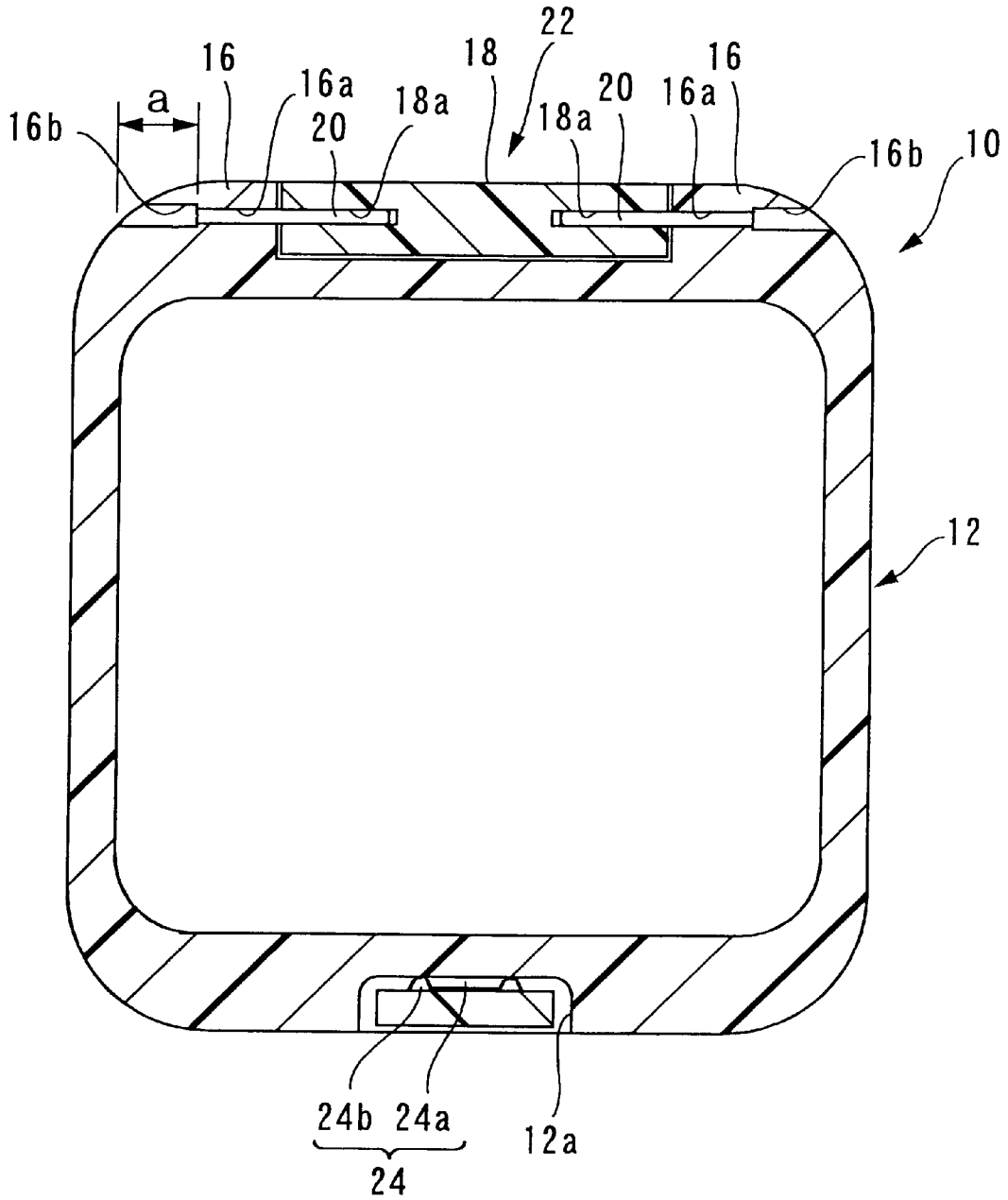
FIG. 2 is a cross section plan view of the first embodiment shown in FIG. 1 taken from the axial centers of the pin bores.
Figure 3:
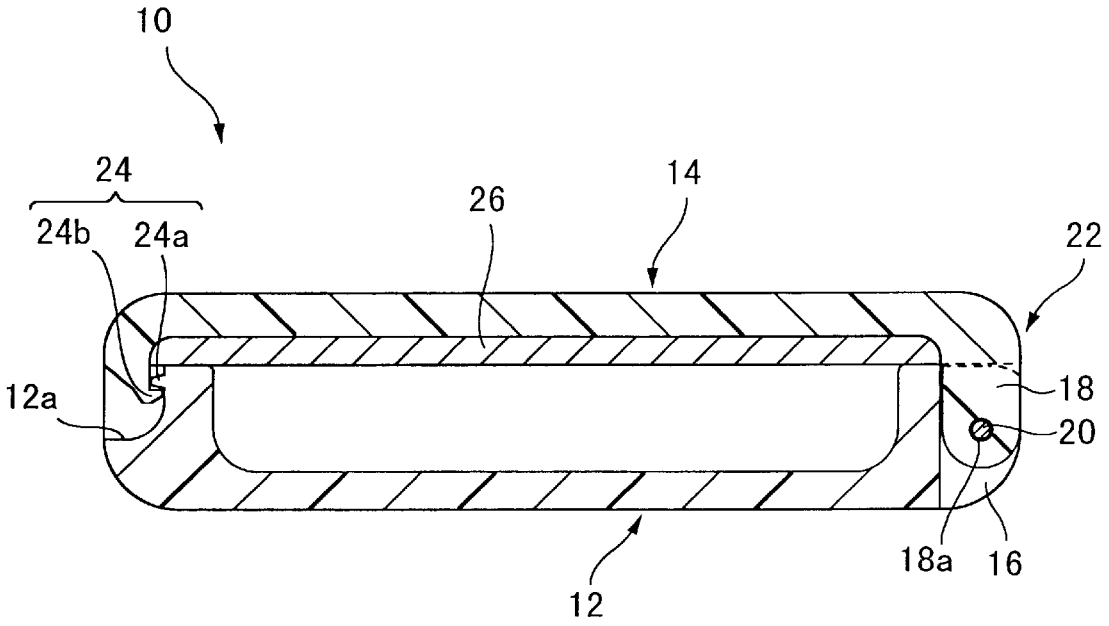
FIG. 3 is a side view cross section of the first embodiment shown in FIG. 1.

FIGS. 1 through 5 provide views of a first embodiment of the invention. As shown in FIGS. 1 and 2, cosmetic case 10 of the first embodiment is comprised of container 12 to which cover 14 is pivotably attached as means of exposing or sealing the contents of container 12. Container 12 and cover 14 are formed by means of a synthetic resin injection molding process. Hinge blocks 16 are integrally formed to each side of the rear extremity of container 12 (front left side of container 12 as shown in FIG. 1). Hinge body 18 is integrally formed to the rear part of cover 14 and is pivotably installed between hinge blocks 16 by means of hinge pins 20 which are inserted within oppositely aligned hinge bores in hinge block 16 and hinge body 18. Cover 14 is thus able to pivot in relation to container 12 as means of exposing or sealing the contents therein. Clasp 24 is installed to the front extremity of cover 14 (right rear side of the cosmetic case as shown in FIG. 1) as means of securely fixing cover 14 in a closed position upon container 12. Clasp 24 is comprised of lip 24*a* formed on the forward edge of container 12, and latch 24*b* formed as a downward and rearward facing protrusion on the forward edge of cover 14. Latch 24*b* maintains a closed joint between cover 14 and container 12 by hooking under lip 24*a*, a condition which can be easily released due to the inherent elasticity of the resin material. Packing piece 26 is installed to the underside of cover 14 as means of sealing the upper peripheral surface of container 12 when cover 14 is in a closed and lock position. A mirror may be installed to the underside of cover 14 in place of packing piece 26.

Hinge pin 20 is formed as a rod shape structure with a uniform diameter along its entire length. Circular hinge bores 16*a* and 18*a* are formed on the same axis within hinge block 16 and hinge body 18 respectively as means of allowing the forcible insertion of hinge pin 20 which aligns and joins the two bores. Hinge pin 20 is forcibly inserted to the hinge bores in hinge block 16 and hinge body 18, but the interference fit creates only a sufficient amount of frictional resistance which allows the pin to frictionally rotate within the bore. The friction generated between hinge pin 20 and the bore wall establishes the aforesaid free stop mechanism as means of maintaining the position of cover 14 at any opened angle. As a result of the free stop mechanism being established in either hinge bore 16*a* or 18*a*, cover 14 can be easily moved, through manually applied pressure, to any open position and remain at that position. Particularly, a smooth free stop operation can be realized due to the elastic adhesive effect generated by like resin pieces in mutual contact. As shown in FIG. 2, guide channel 16*b* is formed at the outward end of hinge bore 16*a* to length 'a' and at a diameter slightly larger than the outer diameter of hinge pin 20. Guide channel 16*b* thus operates to guide hinge pin 20 to the opening of hinge bore 16 when hinge pin 20 is forcibly inserted therein.

Figure 4:
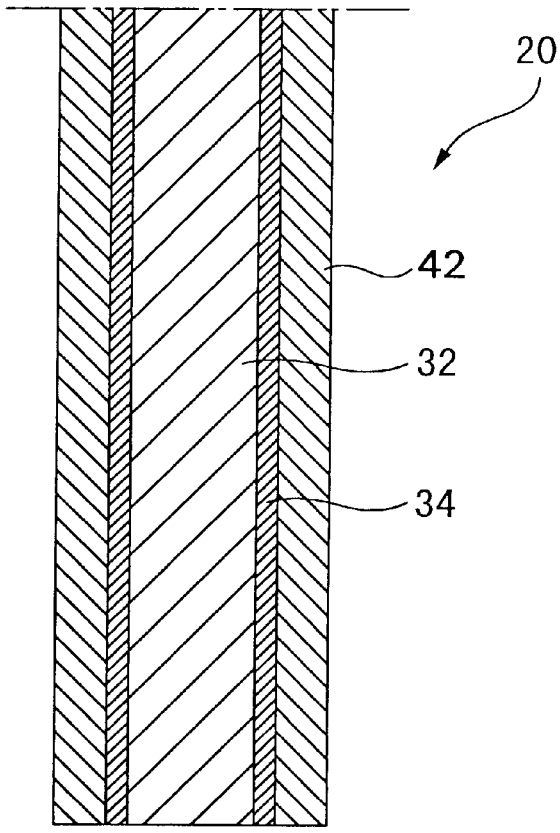
FIG. 4 is an axial cross section of the hinge pin used in the first embodiment shown in FIG. 1.
Figure 5:
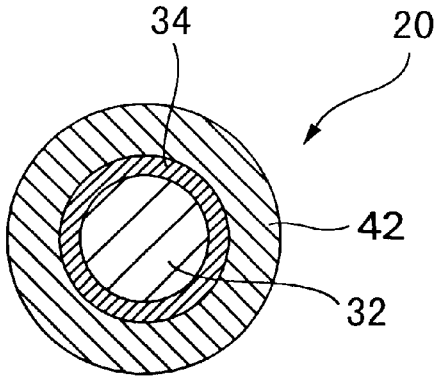
FIG. 5 is a radial cross section of the hinge pin as applied to the first embodiment shown in FIG. 4.

Hinge pin 20 is fabricated from synthetic resin alike container 12 and cover 14, and as shown in FIGS. 4 and 5, is comprised of three concentric layers; outer layer 42, core layer 32, and bonding layer 34 established therebetween. Outer layer 42 is comprised of a relatively soft resin material such as polypropylene or polyethylene, and core layer 32 of a relatively hard resin material such as polycarbonate or nylon. Core layer 32 is formed as a solid cylindrical rod around which outer layer 42 is joined by means of bonding layer 34, outer layer 42 being formed to the desired diameter in relation to the hinge bore. Bonding layer 34 may be comprised of a polymer based adhesive or other like substance.

As hinge pin 20 of hinge 22 is comprised of synthetic resin alike container 12 and cover 14, cosmetic case 10 may be discarded and recycled as a completely plastic item without the need to remove and separate hinge pin 20. The purchaser of the cosmetic case 10 is thus able to easily and conveniently recycle the case to allow re-use of the resin of which it is comprised.

As the outer layer 42 of hinge pin 20, which frictionally contacts the inner walls of hinge bore 16*a* and 18*a*, consists of polypropylene, polyethylene, or other like soft synthetic resin, and as hinge pin 20 is inserted to the hinge pin bores through an interference fit, cover 14 is able to rotate on hinge pin 20 with a certain amount of resistance generated by the elastic adhesion effect which occurs between the hinge bore wall and outer layer of the hinge pin. A mechanism is thus established by which cover 14 can be manually opened and closed with a smooth movement which provides a pleasant tactile sensation to the user, and in which cover 14 is able to maintain an open position at any angle.

Even though outer layer 42 consists of a relatively soft resin, hinge pin 20 is still able to offer a high degree of resistance to bending or buckling due to core layer 32 being formed from a hard resin. Hinge pin 20 is thus able to be forcibly inserted into hinge block 16 and hinge body 18, through interference fit dimensions of the hinge pin and hinge bore walls, without deforming, thus simplifying the assembly of cosmetic case 10.

As the structure of this first embodiment illustrates, hinge pin 20 is able to provide a soft outer surface which allows cover 14 to open or close smoothly with a level of frictional resistance which provides a pleasant tactile feeling. Hinge pin 20 also provides the rigidity needed to prevent the hinge pin from being damaged by forcible insertion into the hinge bore or by open-close movement of the cover, thus realizing significant improvements to the design of and assembly process applied to cosmetic case 10.

Figure 6:
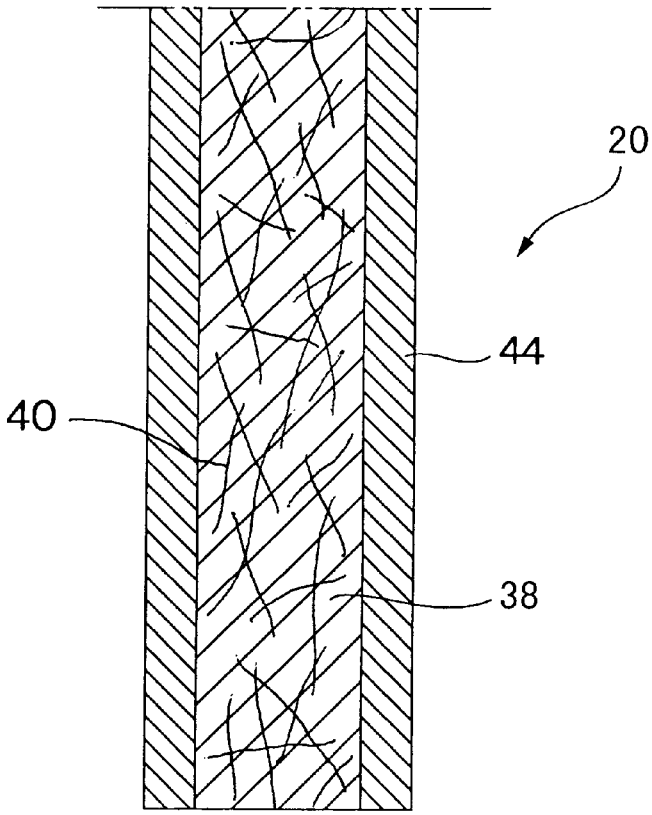
FIG. 6 is an axial cross section of an additional type of hinge pin which can be applied to the first embodiment.
Figure 7:
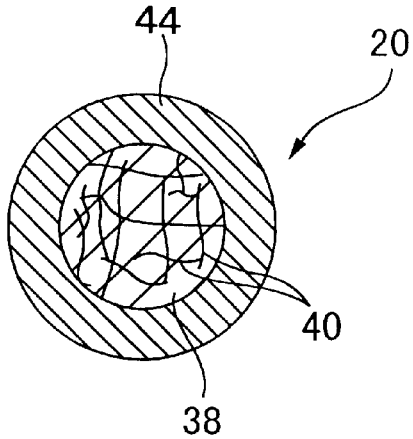
FIG. 7 is a radial cross section of the hinge pin shown in FIG. 6.

FIGS. 6 and 7 show a modification of the first embodiment in which hinge pin 20 is structured of two concentric layers in radial cross section. While both layers consist of the same synthetic resin such as polypropylene or acrylonitrile butadiene styrene (ABS), a lubricating component has been added to outer layer 44, and a fibrous reinforcing component 40 to core layer 38. The aforesaid lubricating component may consist of silicon, and the aforesaid reinforcing fibrous component of glass fiber or carbon fibers. This single base material structure of hinge pin 20 eliminates the need for the bonding layer shown in FIG. 5 in which core layer 32 and outer layer 42 are made from different materials.

This type of single material hinge pin provides for the same operation as the structures shown in FIGS. 1 through 5, an operation in which the lubrication component included in outer layer 44 allows cover 14 to smoothly open and close with a level of resistance that is pleasing to the touch, and in which the fibrous component added to core layer 38 provides an adequate level of strength for hinge pin 20. Both of these characteristics also provide benefits in the form of a faster and easier assembly process for cosmetic case 10.

Figure 8:
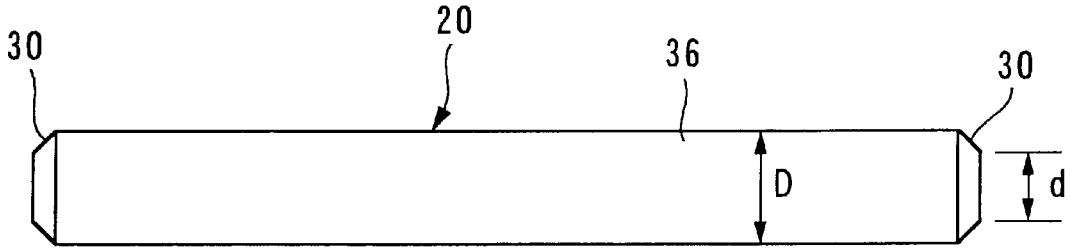
FIG. 8 is a side view of an additional type of hinge pin which can be applied to the first embodiment.

FIG. 8 illustrates a hinge pin configuration wherein reduced diameter part 30 is formed on at least one end of hinge pin 20, FIG. 8 specifically illustrating an example of reduced diameter part 30 formed as a chamfered circumference on both ends of the pin. Inner circumference 'd' of the chamfer is formed to a diameter smaller than diameter 'D' of the hinge pin as means of easily guiding the hinge pin 20 to the center of hinge bore 16*a* and simplifying the pressure insertion operation therein.

Figure 9:
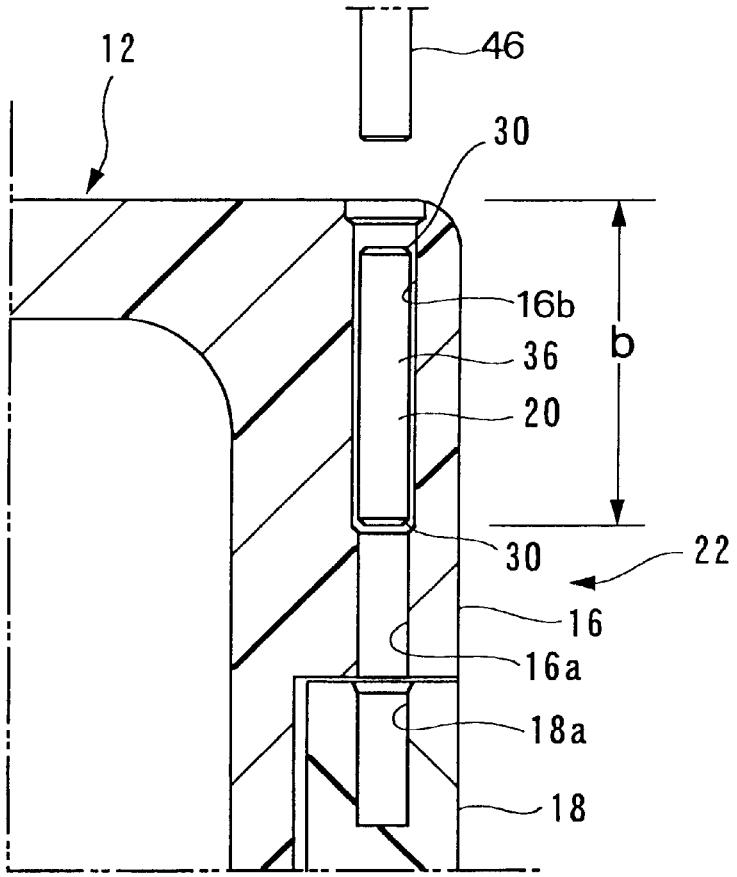
FIG. 9 is a cross sectional view of the structure by which the hinge pin is installed into the cosmetic case.

As shown in FIG. 9, guide bore 16*b* is formed to an axial length at least as long as that of hinge pin 20, and in this case is formed to length 'b' which is longer than hinge pin 20. Hinge pin 20 is thus able to completely reside within guide bore 16*b* before being pressure inserted to bores 16*a* and 18*a* with the use of tool 46. Guide bore 16*b* provides means of preventing hinge pin 20 from bending while being forcibly inserted into bores 16*a* and 18*a*, and thus reduces the time needed to assemble cosmetic case 10.

Figure 10:
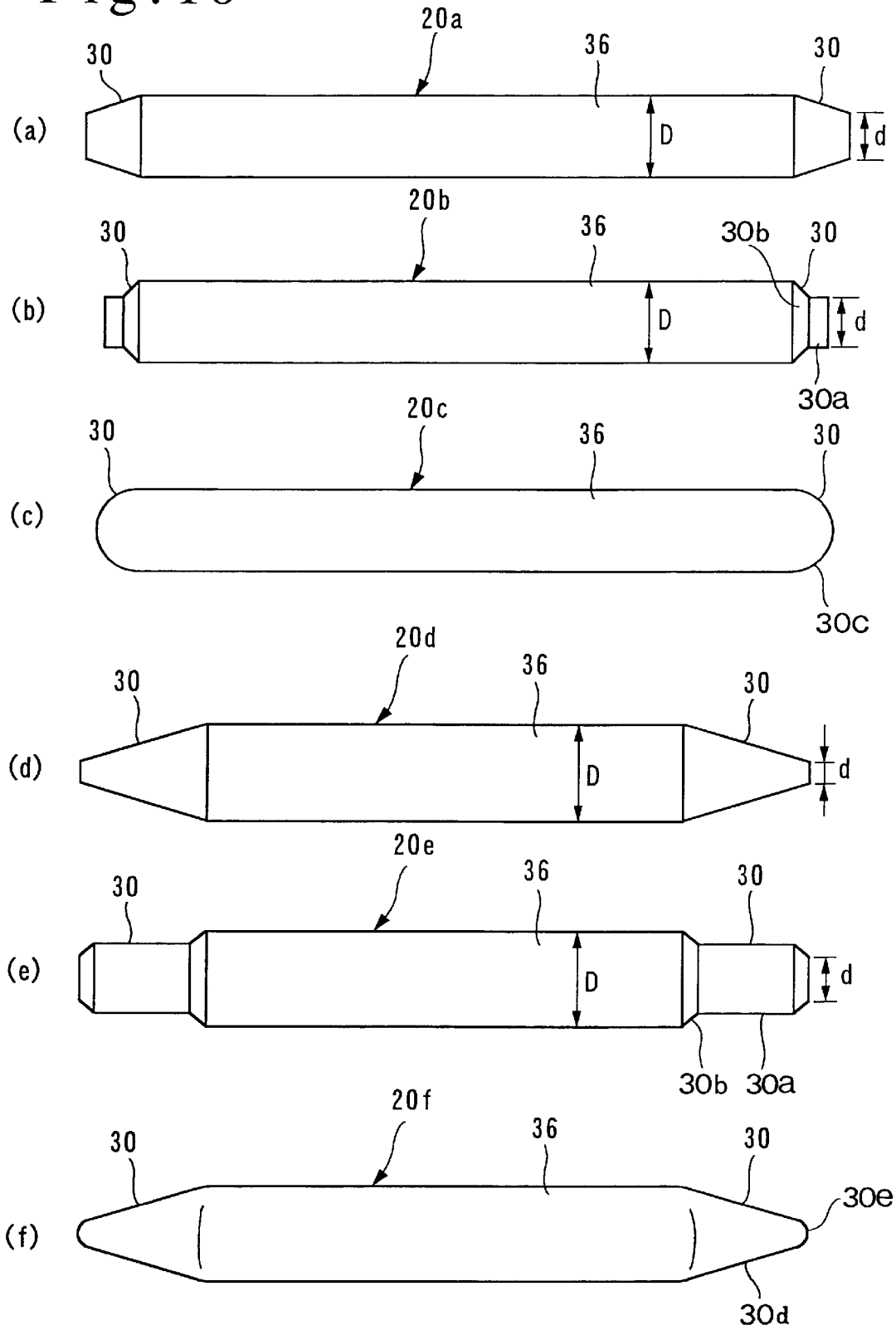
FIG. 10(*a–f*) provides side views of various hinge pin configurations which can be applied to the invention.
Figure 11:
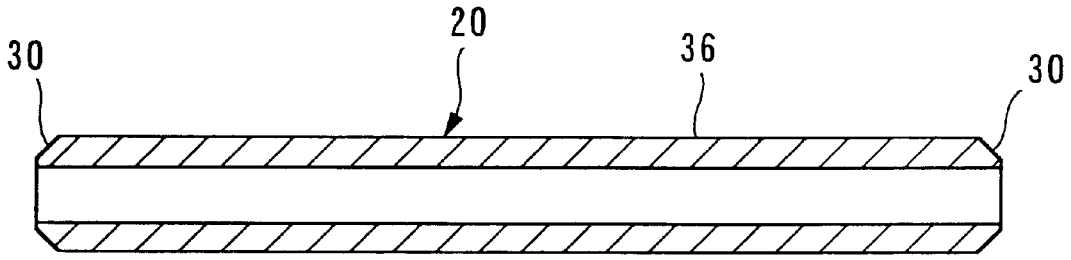
FIG. 11 is an axial cross section of a hinge pin which can be applied to the invention.

While hinge pin 20 is illustrated in FIG. 8 as having reduced diameter part 30 formed on both ends, it is also possible to form part 30 on the insertion end only. Furthermore, reduced diameter part 30 may take other forms in addition to the chamfer shown in FIG. 8, forms such as those shown in FIG. 10. For example, FIG. 10*a* depicts reduced diameter part 30 formed as a conical taper of an angle appropriately established to aid in hinge pin insertion. FIG. 10*b* shows reduced part 30 formed as a smaller diameter cylindrical section 30*a* joined to hinge pin 20*b* through conical taper 30*b*. FIG. 10*c* shows the ends of hinge pin 20*c* formed as simple hemispheres. FIG. 10*d* shows reduced diameter part 30 formed as a long radial taper with a shallower angle than the taper shown in FIG. 10*a*. FIG. 10*e* shows reduced diameter part 30 formed to a similar shape as that of hinge pin 20*b*, but with the smaller diameter cylinder section 30*a* formed to a longer length. FIG. 10*f* provides for a hinge pin having a tapered end similar to that shown in hinge pin 20*d*, but with the end of the conical tapered section formed as hemispherical part 30*e*. Furthermore, each hinge pin shown in FIG. 10(*a–f*) may also be of hollow construction as shown in FIG. 11.

Figure 12:
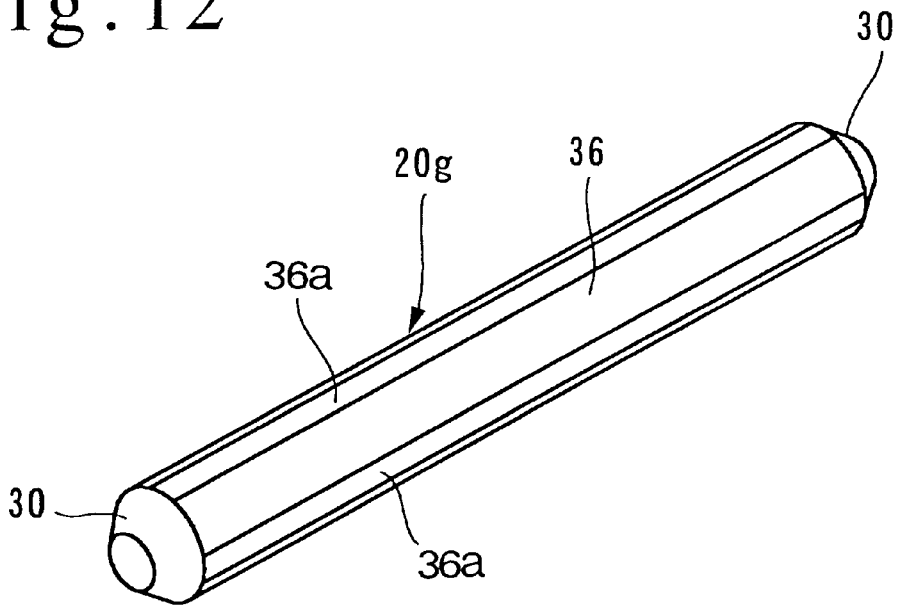
FIG. 12 is an oblique view of a hinge pin which can be applied to the invention.
Figure 13:
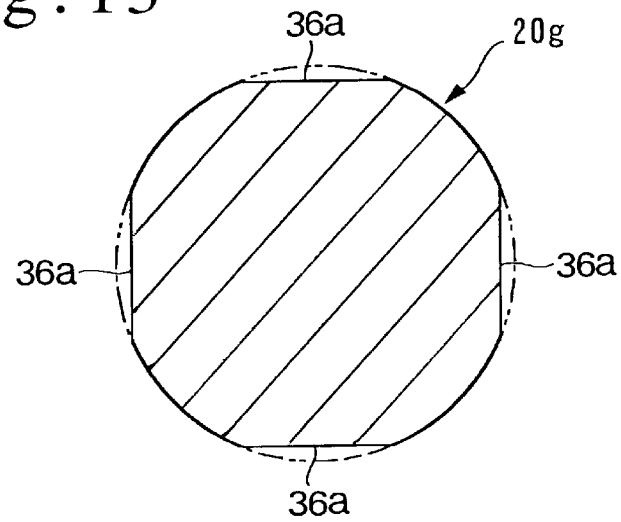
FIG. 13 is a radial cross section of the hinge pin shown in FIG. 12.

FIGS. 12 and 13 illustrate an additional hinge pin structure. Hinge pin 20*g*, which is formed to a non-round cross section, incorporates multiple uniformly spaced flat surfaces 36*a* along its axial length. When hinge pin 20*g* is inserted within round hinge bores 16*a* and 18*a*, flat surfaces 36*a* have the effect of relieving the stress on the hinge pin, stress which is generated by frictional contact with the bore walls, thereby increasing the service life of the hinge pin by reducing both abrasion and torsional distortion.

Figure 14:
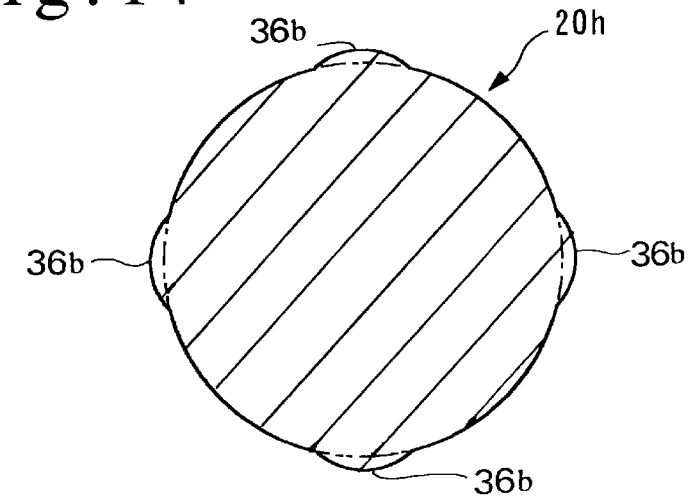
FIG. 14 is a radial cross section of a hinge pin which can be applied to the invention.
Figure 15:
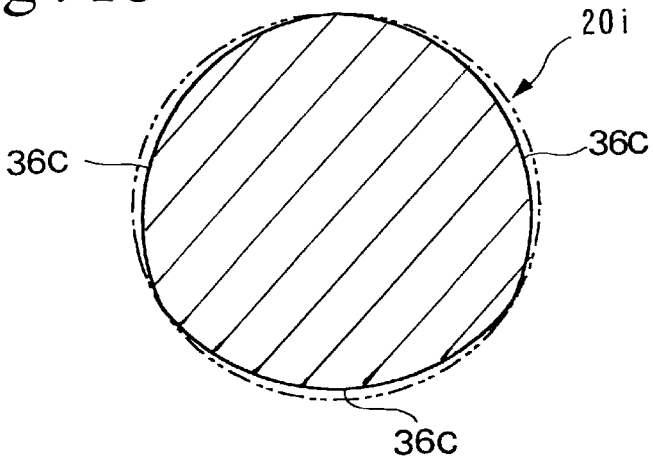
FIG. 15 is a radial cross section of a hinge pin which can be applied to the invention.

Hinge pin 20 can be formed to a variety of cross sections which will provide the same effect as the hinge pin structure shown in FIG. 12 and 13. For example, as shown in FIG. 14, multiple curved convex ridges 36*b* can be formed on the circumference of hinge pin; and as shown in FIG. 15, multiple contours 36*c* can be formed on the surface of hinge pin, contours 36*c* being of a different radius than that of the base radius of the hinge pin.

Figure 16:
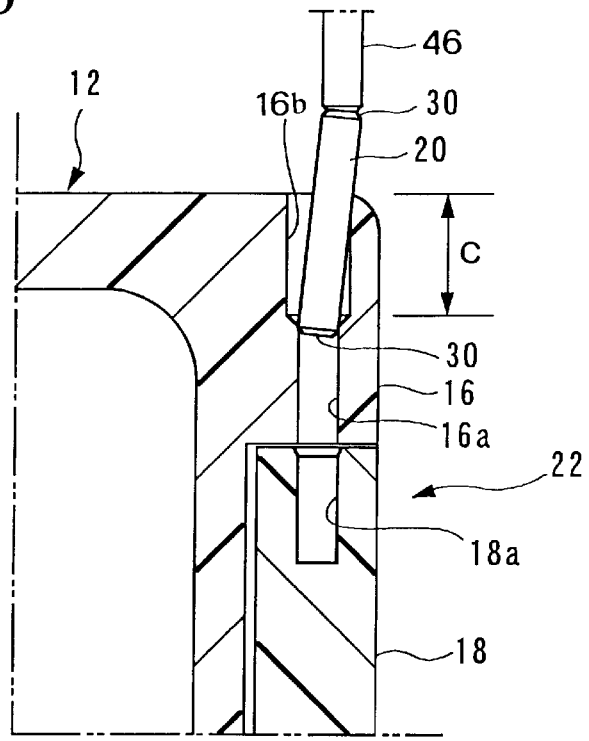
FIG. 16 is a cross sectional view of an additional structure by which the hinge pin is installed into the cosmetic case.
Figure 17:
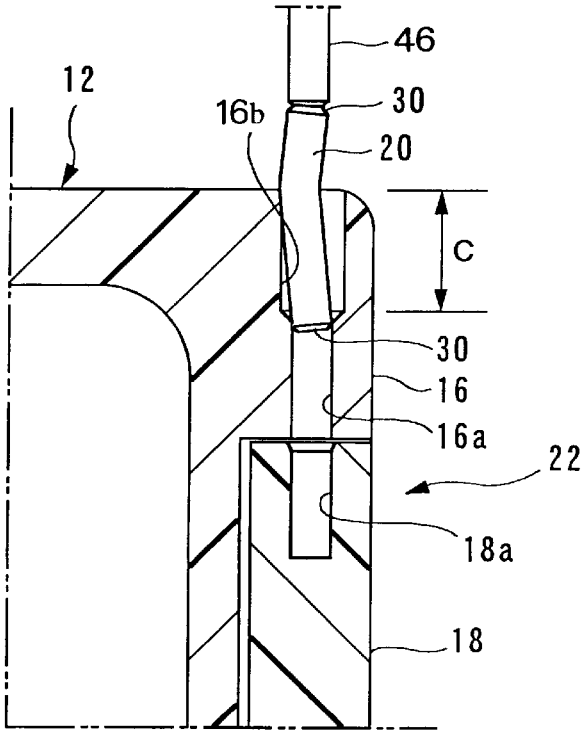
FIG. 17 is a cross sectional view of an additional structure by which the hinge pin is installed into the cosmetic case.
Figure 18:
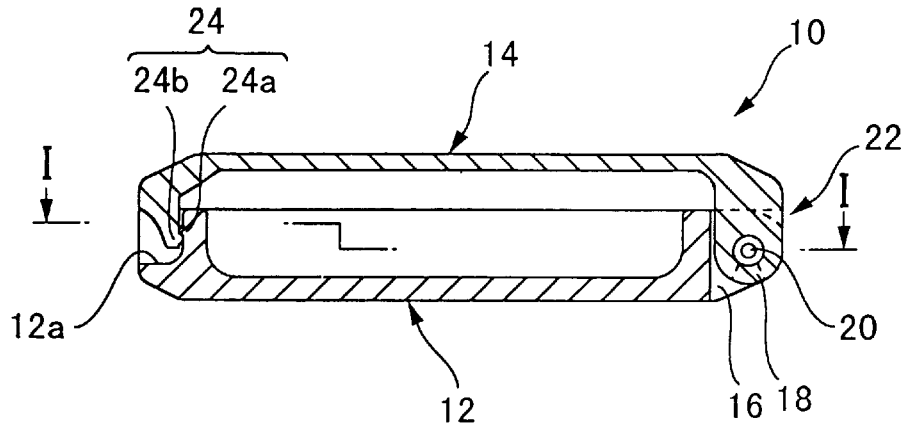
FIG. 18 is a side view cross section of a second embodiment of the invention.
Figure 19:
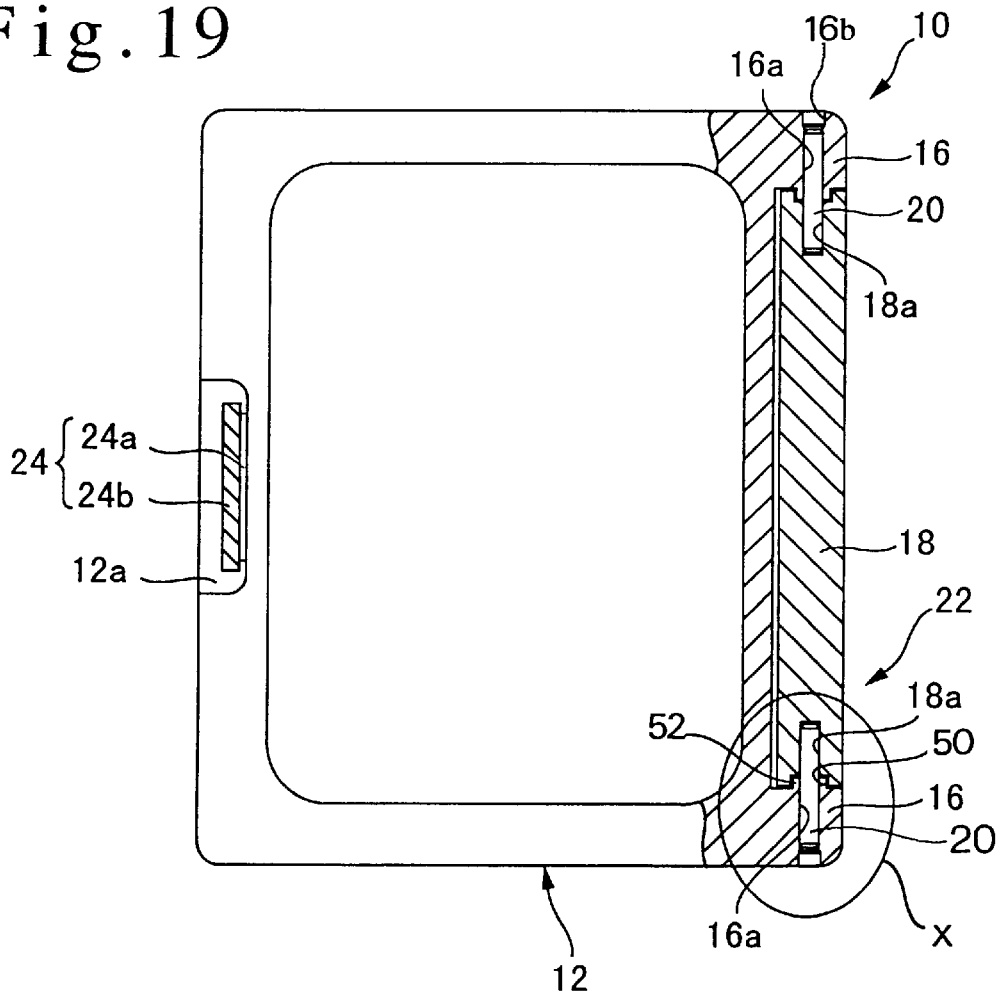
FIG. 19 is a plan view cross section taken from line 'I—I' of FIG. 18.

As explained previously, guide bore 16*b* can be formed to a length equal to or longer than that of hinge pin 20. However, it is also possible to form guide bore 16*b* to any length which provides the desired guide function for the insertion of hinge pin 20 into bores 16*a* and 18*a*. For example, as shown in FIGS. 16 and 17, length 'c' of guide bore 16*b* is established to a length approximately half that of hinge pin 20. This structure also provides a mechanism whereby hinge pin 20 can be forcibly yet smoothly inserted to hinge bores 16*a* and 18*a* without deforming.

Figure 20:
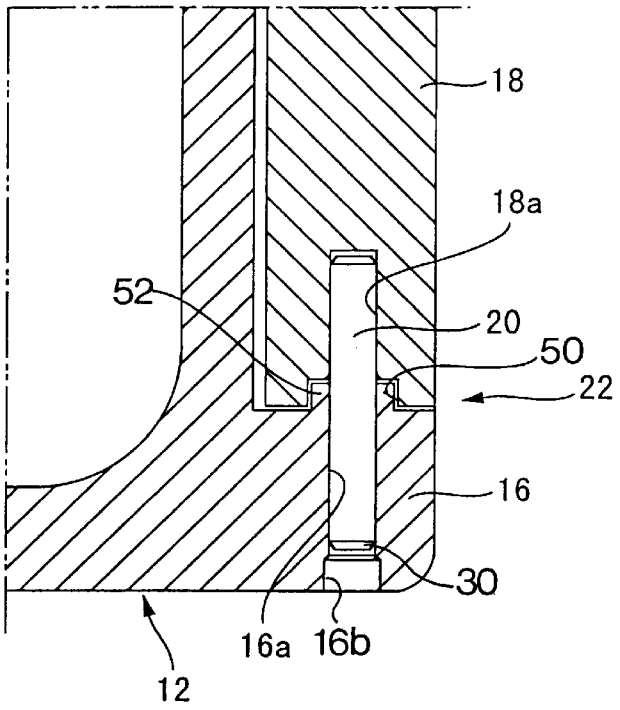
FIG. 20 is an enlarged view of the area encompassed by circle 'X' of FIG. 19.
Figure 21:
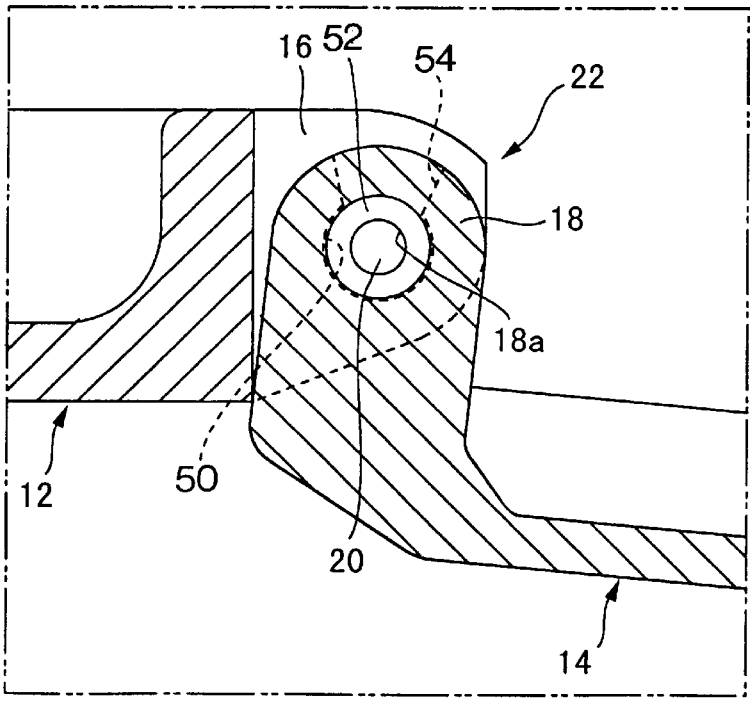
FIG. 21 is a side cross section of the hinge mechanism shown in FIG. 18 with the cover part open.
Figure 22:
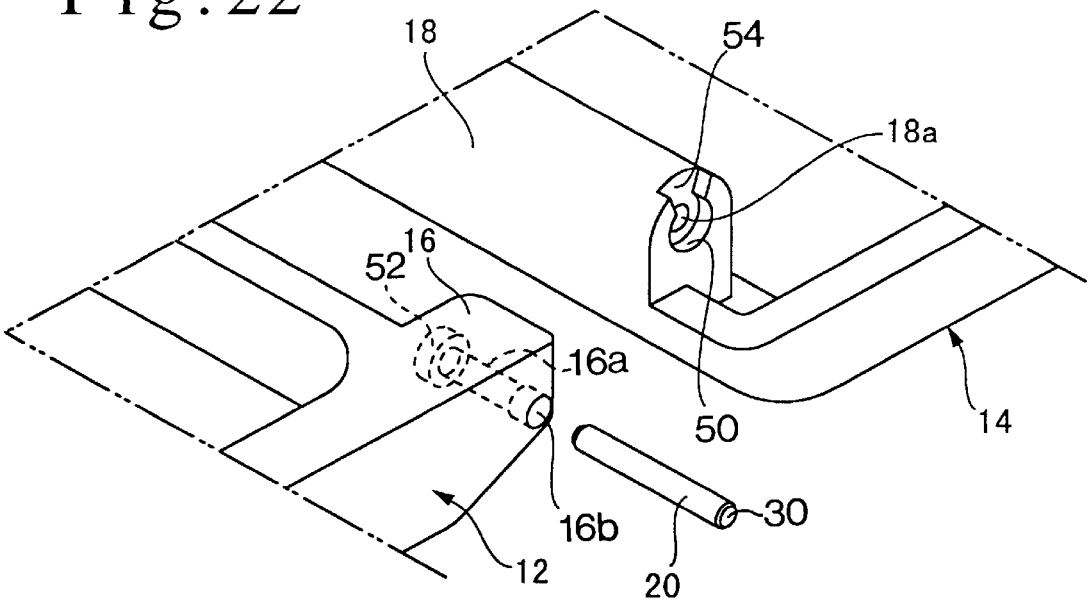
FIG. 22 is an oblique exploded view of the hinge mechanism shown in FIG. 18.

FIGS. 18 through 22 put forth a second embodiment of the invention wherein hinge pin 20 need not be formed to any specific structure as presented in the first embodiment. As shown in FIG. 20, collar flange 50 and oppositely mating center boss 52 are concentrically formed around the hinge bores within hinge body 18 and hinge block 16 respectively. As shown in FIG. 22, cutout section 54 is formed radially within peripheral flange 50 and concentric to hinge bore 18*a* as means of allowing center boss 52 to be inserted within collar flange 50.

Cutout section 54 is a radially expanding fan shape in which the opening at the outer perimeter is wider than, and the inner perimeter slightly smaller than the diameter of circular boss 52. That is, the wider opening at the outwardly facing side of cutout section 54 allows boss 52 to easily insert therein, while the smaller opening at its inwardly facing side provides frictional resistance against the continued insertion of boss 52. Due to the elastic property of the synthetic resin of which hinge body 18 and hinge block 16 are comprised, however, sufficient pressure applied to boss 52 forcibly widens the inwardly facing side of cutout section 54, thus allowing boss 52 to be inserted concentrically within collar flange 50. Moreover, the shape of cutout section 54 is not limited to the fan shape explained in this embodiment.

Because synthetic resin hinge pin 20 does not provide the same shear strength and rigidity as a metallic hinge pin, the hinge structure in which center boss 52 resides concentrically within collar flange 50, at the joint between hinge body 18 and hinge block 16, provides means of absorbing shear stress which would otherwise be applied directly to hinge pin 20. As most of the shear stress generated by the opening and closing movement of cover 14 in relation to container 12 is applied to the rotating joint formed between collar flange 50 and center boss 52, stress on synthetic resin hinge pin 20 is significantly reduced and damage to the hinge pin is prevented.

Because cutout section 54 is provided as means of easily inserting circular boss 50 into peripheral flange 52, there is no need to forcibly expand the area between the hinge blocks 16, 16 when assembling cover 14 to container 12. As a result, this mechanism hastens and simplifies the procedure by which the cosmetic case is assembled. Moreover, as the width of the inward side of cutout section 54 is smaller than the diameter of center boss 52, a mechanism is created whereby circular flange 52 is secured within peripheral flange 50 even during the opening and closing movement of cover 14.

Figure 23:
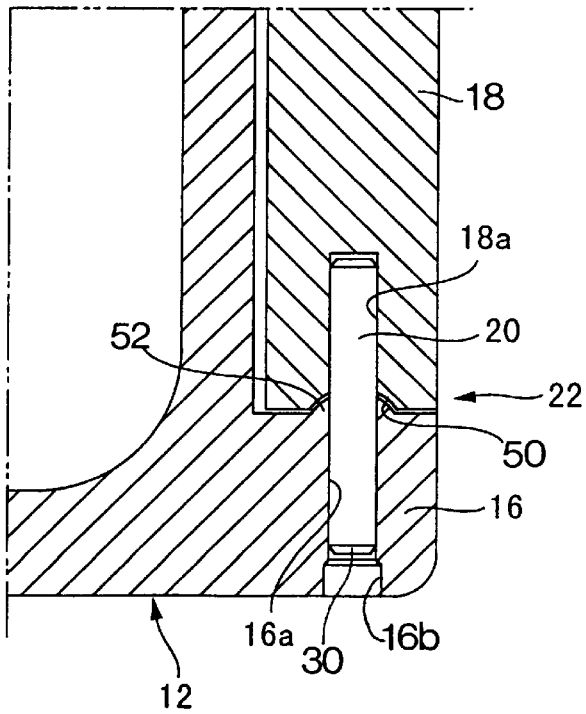
FIG. 23 is a variation of the hinge mechanism shown in FIG. 20.

FIG. 23 shows a modification of the hinge structure shown in FIG. 20 whereby peripheral flange 50 and circular boss 52 are formed as mutually opposing curved concave and convex shapes respectively. This particular structure is also able to aid in the assembly of hinge body 18 and hinge block 16, eliminate the need for cutout section 54, and still retain the advantage of providing for fast and easy assembly of the hinge block and body. Moreover, the joined surfaces between peripheral flange 50 and circular boss 52 may also exist as conical tapers.

The second embodiment of the collar flange and center boss hinge structure shown in FIGS. 19 through 23 can also be advantageously applied to the hinge structures shown in FIGS. 8 through 17.

The synthetic resin hinge pin put forth by the invention provides for an enhanced appearance of quality and color uniformity on cosmetic case not possible with conventional metallic hinge pins, qualities which can be can be equally applied to the first and second embodiments as well as their modifications.

Figure 24:
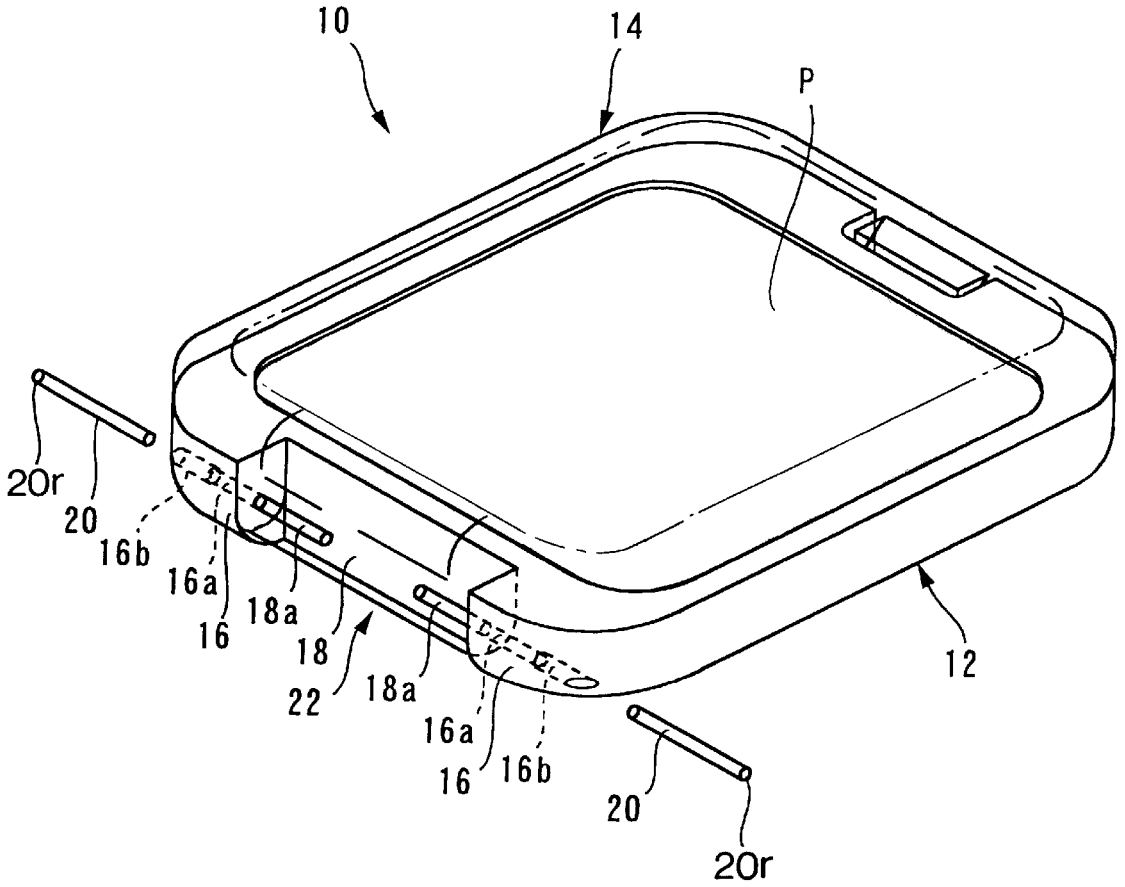
FIG. 24 is an oblique view of a transparent container part of the invention with the hinge pins in an uninstalled position.

As shown in FIG. 24, end part 20*r* of hinge pin 20, hinge body 16 which houses end part 20*r*, and container 12 are not only of the same color, but are formed of the same synthetic resin. Container 12 and cover 14 are formed through an injection molding process which can mold various types of synthetic resins such as polypropylene, acrylonitrile butadiene styrene (ABS), styrol, AS resin, and other like plastics. While container 12 and cover 14 may be comprised of the same synthetic resin, a different resin may also be utilized for each component.

As an example of the mechanical properties of the aforesaid synthetic resins, polypropylene has a tensile fatigue strength of 240–300 kgf/cm$^2$, an elastic modulus of 9,500–11,500 kgf/cm$^2$, and an impact strength of from 4.5–18 kgf*cm/cm. ABS resin has a tensile fatigue strength of 410–600 kgf/cm$^2$, an elastic modulus of 18,000–28,500 kgf/cm$^2$, and an impact strength of from 5–20 kgf*cm/cm. Styrol resin has a tensile fatigue strength of 3,000–6,300 p.s.i., an elastic modulus of 4,500–8,100 p.s.i., and an impact strength of from 0.4–1.1 ft*lb/in. AS resin has a tensile fatigue strength of 740–820 kg/cm$^2$, an elasticity modulus of 1,000–1100 kg/cm$^2$, and an impact strength of from 1.4–1.7 kg*cm/cm.

Because hinge pin 20 is the same color as container 12, end part **20*r* blends in with the color of the surrounding material, thus improving the appearance of cosmetic case 10** and increasing its perceived value.

Because hinge pin 20 and container 12 are made from the same synthetic resin, a single injection molding dieset can be used to mold both container 12 and hinge pin 20, thus reducing the number of component fabrication processes and lowering manufacturing costs. Moreover, if the same synthetic resin is used for the entire cosmetic case, cover 14, container 12, and hinge pin 20 can be simultaneously molded from the same injection molding dieset, thus providing for a further decrease in manufacturing cost. In the same manner as with the previously described separate hinge pin structure, because an integrally molded hinge pin 20 is comprised of the same synthetic resin and is the same color as container 12, hinge pin 20 is able to blend in with the color of the surrounding material thus improving the appearance of cosmetic case 10 and increasing the perceived value of the product.

Because hinge block 16 is highly visible at its position on an outward facing surface of container 12, this embodiment portrays hinge pin 20 as consisting of the same synthetic resin and being the same color as container 12. In cases where hinge body 18 is formed on a highly visible outward surface of cover 14, hinge pin 20 and cover 14 may also be of the same color and synthetic resin material.

Moreover, container 12 and cover 14 may also be made of a transparent synthetic resin, a material which would lend an appearance of enhanced artistic design to the cosmetic case. For example, if cover 14 were to be made of a transparent resin, cosmetic substance 'P' would be visible through cover 14, and hinge pin 20, also being of the same transparent resin, would not interfere with the overall appearance of transparency of cover 14. As hinge pin 20 becomes almost visually indistinguishable from cover 14, the problem of an esthetically displeasing metallic hinge pin being noticeably apparent in a transparent cosmetic case is eliminated.

The embodiments presented here have portrayed a pair of hinge blocks 16, one of which is integrally formed on each outwardly facing side of container 12, and hinge body 18 formed integrally at the center of one outwardly facing side of cover 14. The mutual arrangement of hinge blocks 16 and hinge body 18 is not limited to this example alone. The arrangement of hinge blocks 16 and hinge body 18 may be reversed, that is, one hinge block 16 may be positioned in the center of a pair of hinge bodies 18.

Furthermore, while the embodiments presented here have portrayed the invention as a cosmetic case, the various structures of the invention can be applied to other items which would benefit from the functions that the invention provides. Moreover, the invention may also be applied to a cosmetic case of the type which incorporates a replaceable inner tray, a replaceable inner cosmetic container, a receptacle for a cosmetic application tool, or other components, features, and functions. The invention can be applied to any type of cosmetic case in which a synthetic resin container part is joined to a synthetic resin cover part by means of a pin type hinge mechanism. The invention can also be applied to a refill type cosmetic container which is removably installed within a cosmetic case.

What is claimed is:

1. A cosmetic case comprised of a container part and cover part both consisting of a synthetic resin material, a mutually connecting hinge block part and hinge body part integrally formed to said container part and cover part respectively, a hinge pin bore formed through said hinge block and hinge body, and a synthetic resin hinge pin installed within said hinge bore as means of pivotably connecting said hinge block and hinge body, wherein said hinge pin is a concentric three layer structure in radial cross section, an outer layer of said hinge pin consisting of a soft resin material, an inner core layer of said hinge pin consisting of a hard resin material, and a middle layer of said hinge pin there between as a bonding layer.

2. A cosmetic case as put forth in claim 1 wherein said outer layer consists of polypropylene or polyethylene resin.

3. A cosmetic case as put forth in claim 1 wherein said inner core layer consists of polycarbonate or nylon.

4. A cosmetic case as put forth in claim 1 wherein a rotatably connecting collar flange and center boss are formed around said hinge pin on said hinge block and hinge body respectively.

5. A cosmetic case as put forth in claim 4 wherein said collar flange and center boss are cylindrical in shape, and wherein a cutout section is radially formed within said collar flange as means of allowing the insertion of said center boss therein.

6. A cosmetic case as put forth in claim 4 wherein the joined area of said collar flange and center boss is of hemispherical shape.

7. A cosmetic case as put forth in claim 1 wherein a guide bore is concentrically formed within the outward extending length of said hinge pin bore, said guide bore being formed to a diameter larger than said hinge pin and serving as means of guiding said hinge pin during its insertion to said hinge pin bore.

8. A cosmetic case as put forth in claim 7 wherein said guide bore is the same length as or longer than the length of said hinge pin.

9. A cosmetic case as put forth in claim 1 wherein the insertion end of said hinge pin is formed to a smaller diameter than the hinge pin shank as means of guiding the insertion of said hinge pin into said hinge pin bore.

10. A cosmetic case as put forth in claim 1 wherein a circumferential surface of said hinge pin is contoured, by means of a non-round hinge pin cross section, so as to come into partial contact with said round hinge pin bore.

11. A cosmetic case as put forth in claim 1 wherein said hinge pin is the same color as at least one of said container part and cover part.

12. A cosmetic case as put forth in claim 1 wherein said hinge pin is constructed transparently alike at least one of said container part and cover part.

13. A cosmetic case as put forth in claim 1 wherein said hinge pin is constructed of the same resin material as said container part, or cover part, or both.

14. A cosmetic case comprised of a container part and cover part both consisting of a synthetic resin material, a mutually connecting hinge block part and hinge body part integrally formed to said container part and cover part respectively, a hinge pin bore formed through said hinge block and hinge body, and a synthetic resin hinge pin installed within said hinge bore as means of pivotably connecting said hinge block and hinge body, wherein said hinge pin is of a concentric two layer structure in radial cross section, said structure consisting of an outer layer and inner core layer both comprised of the same synthetic resin material, said outer layer containing a lubricating component, and said inner core layer containing a reinforcing component.

15. A cosmetic case as put forth in claim 14 wherein said lubricating component is silicon.

16. A cosmetic case as put forth in claim 14 wherein said reinforcing component is glass fiber or carbon fiber.

17. A cosmetic case as put forth in claim 14 wherein a rotatably connecting collar flange and center boss are formed around said hinge pin on said hinge block and hinge body respectively.

18. A cosmetic case as put forth in claim 17 wherein said collar flange and center boss are cylindrical in shape, and wherein a cutout section is radially formed within said collar flange as means of allowing the insertion of said center boss therein.

19. A cosmetic case as put forth in claim 17 wherein a joined area of said collar flange and center boss is of hemispherical shape.

20. A cosmetic case as put forth in claim 14 wherein a guide bore is concentrically formed within the outward extending length of said hinge pin bore, said guide bore being formed to a diameter larger than said hinge pin and serving as means of guiding said hinge pin during its insertion to said hinge pin bore.

21. A cosmetic case as put forth in claim 20 wherein said guide bore is at least the same length as said hinge pin.

22. A cosmetic case as put forth in claim 14 wherein the insertion end of said hinge pin is formed to a smaller diameter than the hinge pin shank as means of guiding the insertion of said hinge pin into said hinge pin bore.

23. A cosmetic case as put forth in claim 14 wherein the circumferential surface of said hinge pin is contoured, by means of a non-round hinge pin cross section, so as to come into partial contact with said round hinge pin bore.

24. A cosmetic case as put forth in claim 14 wherein said hinge pin is the same color as said container part, or cover part, or both.

25. A cosmetic case as put forth in claim 14 wherein said hinge pin is constructed transparently alike said container part, or cover part, or both.

26. A cosmetic case as put forth in claim 14 wherein said hinge pin is constructed of the same resin material as said container part, or cover part, or both.

* * * * *